US010352648B2

(12) United States Patent
Underwood et al.

(10) Patent No.: US 10,352,648 B2
(45) Date of Patent: Jul. 16, 2019

(54) REAR TRUNNION AND FOLDING STOCK FITTING ASSEMBLIES

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 16/126,967

(22) Filed: Sep. 10, 2018

(65) Prior Publication Data

US 2019/0003802 A1 Jan. 3, 2019

Related U.S. Application Data

(63) Continuation of application No. 15/428,672, filed on Feb. 9, 2017, now Pat. No. 10,088,265.

(60) Provisional application No. 62/293,058, filed on Feb. 9, 2016.

(51) Int. Cl.

| | |
|---|---|
| ***F41C 23/20*** | (2006.01) |
| ***F41C 23/04*** | (2006.01) |
| ***F41A 3/66*** | (2006.01) |

(52) U.S. Cl.

CPC ..... *F41C 23/04* (2013.01); *F41A 3/66* (2013.01); *F41C 23/20* (2013.01)

(58) Field of Classification Search

CPC ..... F41C 23/20; F41C 23/04; F41C 23/06
USPC ..... 42/75.01, 75.03
See application file for complete search history.

(56) References Cited

U.S. PATENT DOCUMENTS

| | | | | |
|---|---|---|---|---|
| 896,997 | A * | 8/1908 | Lard | F41A 19/10 42/69.01 |
| 1,583,616 | A * | 5/1926 | Smith | F41C 23/00 42/75.03 |
| 2,425,412 | A * | 8/1947 | Barnes | F41A 9/19 42/69.02 |
| 3,369,316 | A | 2/1968 | Miller | |
| 6,886,286 | B2 * | 5/2005 | Dowding | F41C 23/00 42/71.01 |
| 7,162,823 | B2 * | 1/2007 | Schoppman | F41A 11/04 42/75.01 |
| 7,673,412 | B2 | 3/2010 | Griffin | |
| 7,827,721 | B2 | 11/2010 | Griffin | |

(Continued)

OTHER PUBLICATIONS

Notice of Allowance from related U.S. Appl. No. 15/428,672 dated May 17, 2018, 10 pages.

*Primary Examiner* — Reginald S Tillman, Jr.
(74) *Attorney, Agent, or Firm* — Kilpatrick Townsend & Stockton LLP

(57) ABSTRACT

A rear trunnion assembly includes: a modular rear trunnion fitting including a rear connection feature, an upper portion, and a lower portion; a folding hinge fitting including an upper lug, a lower lug, and a forward portion disposed under the modular rear trunnion fitting, the folding hinge fitting disposed on a rear side of the modular rear trunnion fitting, the forward portion including a first mounting hole configured to interface with the upper portion and a second mounting hole configured to interface with the lower portion; and a pivoting latch fitting configured to pivot with respect to the folding hinge fitting about an axis extending from the upper lug to the lower lug. The pivoting latch fitting may be configured to lock in at least one position with respect to the folding hinge fitting.

10 Claims, 12 Drawing Sheets

(56) References Cited

U.S. PATENT DOCUMENTS

| | | | | |
|---|---|---|---|---|
| 8,312,661 | B2 | 11/2012 | Ludlow | |
| 8,656,623 | B1 | 2/2014 | Chvala | |
| 8,769,855 | B2 | 7/2014 | Law | |
| 8,991,088 | B1 * | 3/2015 | Young | F41A 25/00 42/75.03 |
| 9,228,795 | B1 | 1/2016 | Kielsmeier | |
| 9,546,845 | B2 | 1/2017 | Mather | |
| 2007/0089347 | A1 * | 4/2007 | Webber | F41A 11/02 42/75.03 |
| 2009/0019757 | A1 * | 1/2009 | Moretti | F41A 3/66 42/75.03 |
| 2010/0132240 | A1 * | 6/2010 | Webber | F41A 11/02 42/75.03 |
| 2015/0176945 | A1 * | 6/2015 | Simek | F41A 3/64 42/75.03 |
| 2015/0219416 | A1 * | 8/2015 | Chvala | F41C 23/04 42/71.01 |
| 2016/0178314 | A1 * | 6/2016 | Kielsmeier | F41C 23/14 42/73 |

* cited by examiner

REAR TRUNNION AND FOLDING STOCK FITTING ASSEMBLIES

CROSS REFERENCE TO RELATED APPLICATIONS

This application is a continuation of U.S. patent application Ser. No. 15/428,672 ("the '672 application") filed Feb. 9, 2017, which is related to and claims priority benefit from U.S. Provisional Application No. 62/293,058 ("the '058 application"), filed on Feb. 9, 2016, entitled REAR TRUNNION AND FOLDING STOCK FITTING ASSEMBLIES. The '058 application and the '672 application are hereby incorporated in their entireties by this reference.

FIELD OF THE INVENTION

The field of the invention relates to firearms, particularly rear trunnion fitting assemblies and folding stock fitting assemblies for firearms.

BACKGROUND

One of the most ubiquitous and well-recognized weapons, the AK-47 rifle was designed and entered service in the mid to late 1940s. The designer, Mikhail Kalashnikov, also designed the AK-74 (variants of which are still being produced), which shares numerous parts with the AK-47 and its variants. The typical configuration for the Kalishnikov firearms include a rear trunnion fitting configured to interface with a fixed (non-folding) stock.

To ensure modularity and compatibility with various stock configurations including, for example, fixed stocks, side-folding stocks, and under-folding stocks, the firearm may be designed with a different rear trunnion fitting and/or a new folding hinge fitting.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a rear trunnion assembly comprises: a modular rear trunnion fitting including a rear connection feature, an upper portion, and a lower portion; a folding hinge fitting including an upper lug, a lower lug, and a forward portion disposed under the modular rear trunnion fitting, the folding hinge fitting disposed on a rear side of the modular rear trunnion fitting, the forward portion including a first mounting hole configured to interface with the upper portion and a second mounting hole configured to interface with the lower portion; and a pivoting latch fitting configured to pivot with respect to the folding hinge fitting about an axis extending from the upper lug to the lower lug. The pivoting latch fitting may be configured to lock in at least one position with respect to the folding hinge fitting.

According to certain embodiments of the present invention, a rear trunnion assembly for a firearm comprises: a modular rear trunnion fitting attached to a rear portion of a receiver of the firearm, the modular rear trunnion fitting comprising a rear connection feature, an upper portion, and a lower portion; a folding hinge fitting including an upper lug, a lower lug, and a forward portion disposed within the receiver under the modular rear trunnion fitting, the folding hinge fitting disposed on a rear side of the modular rear trunnion fitting, the forward portion including a first mounting hole configured to interface with the upper portion and a second mounting hole configured to interface with the lower portion; a pivoting latch fitting attached to a forward portion of a stock of the firearm, the pivoting latch fitting configured to pivot with respect to the folding hinge fitting about an axis extending from the upper lug to the lower lug; and a push button arm comprising an engaging arm. The pivoting latch fitting may be configured to lock in at least one position with respect to the folding hinge fitting. The folding hinge fitting may include at least one surface that is continuous with an outer surface of the receiver.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments focus on assault rifles and, in particular, Kalashnikov rifles, the features, concepts, and functions described herein are also applicable (with potential necessary alterations for particular applications) to other assault rifles, rifles, carbines, shotguns, handguns, or any other type of firearm.

Figure 1:
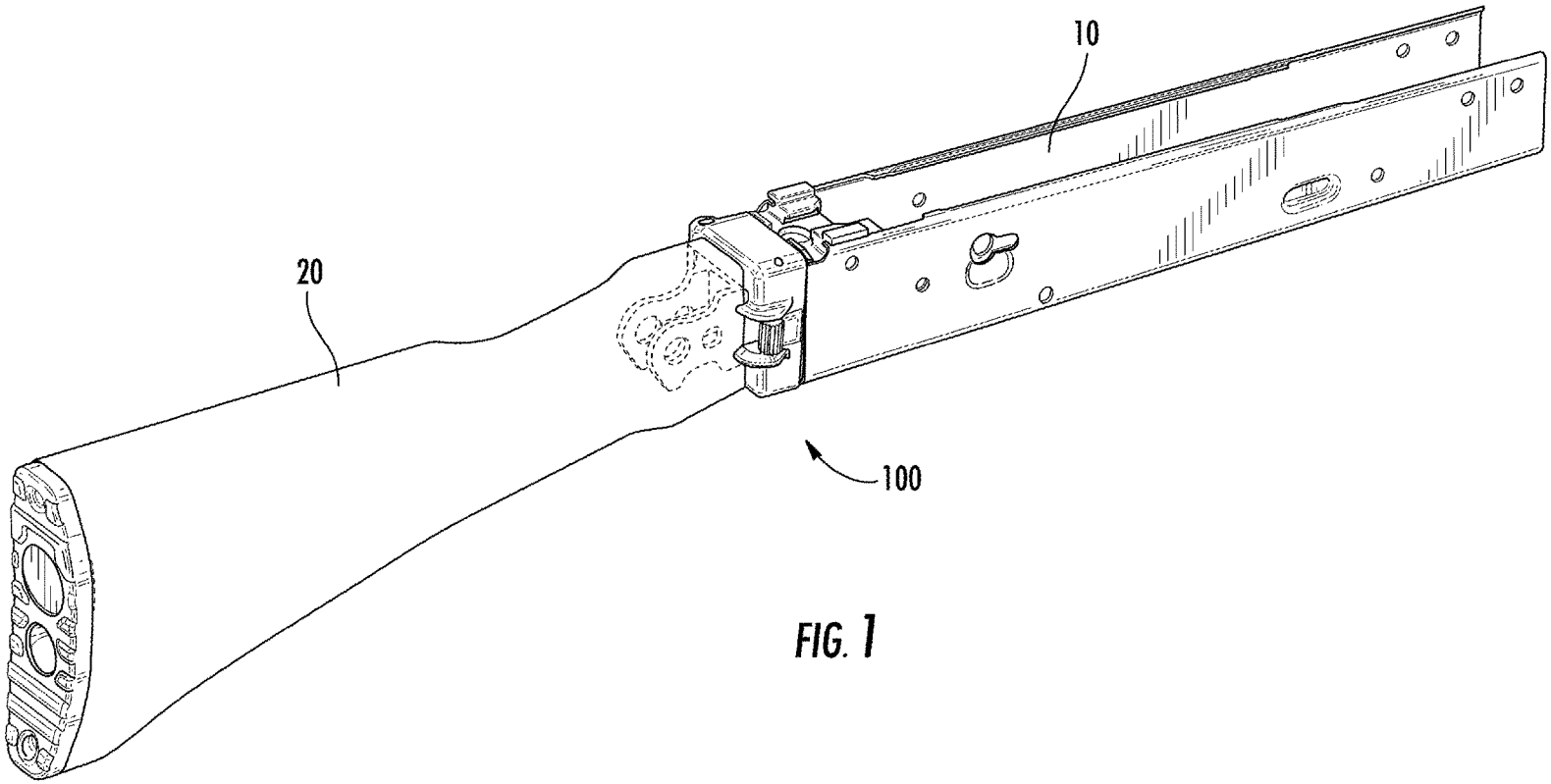
FIG. 1 is a perspective view of a rear trunnion assembly, according to certain embodiments of the present invention.

According to certain embodiments of the present invention, as shown in FIG. 1, a firearm comprises a receiver 10, a stock 20, and a rear trunnion assembly 100. As shown in FIGS. 2A, 2B, 8A, and 8B, in some embodiments, the rear trunnion assembly 100 may include one or more of a modular rear trunnion fitting 101, a removable tang 102, a folding hinge fitting 103, and a pivoting latch fitting 104.

Figure 4A:
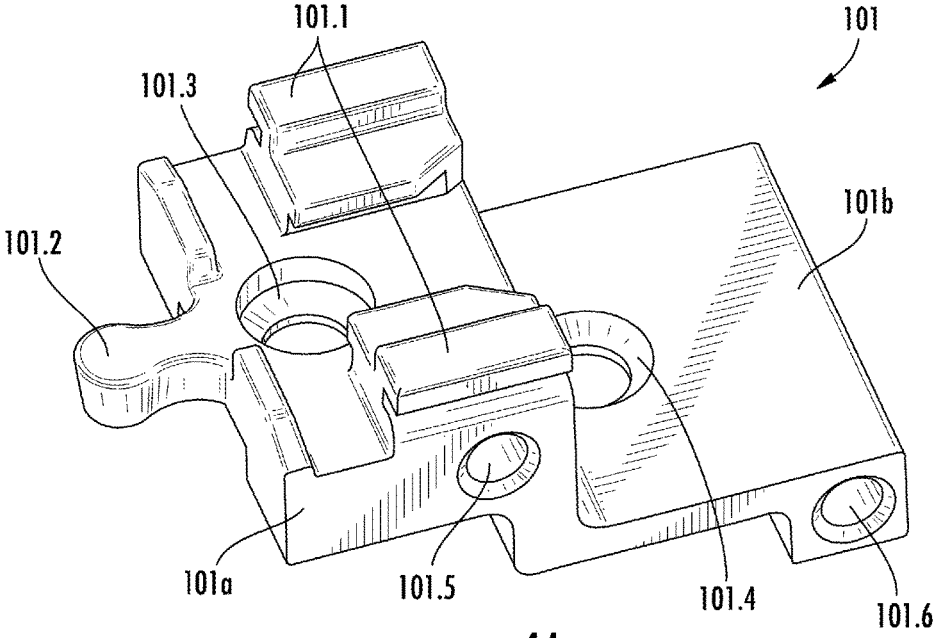
FIGS. 4A and 4B are perspective views of a modular rear trunnion fitting of the rear trunnion assembly of FIG. 1.
Figure 4B:
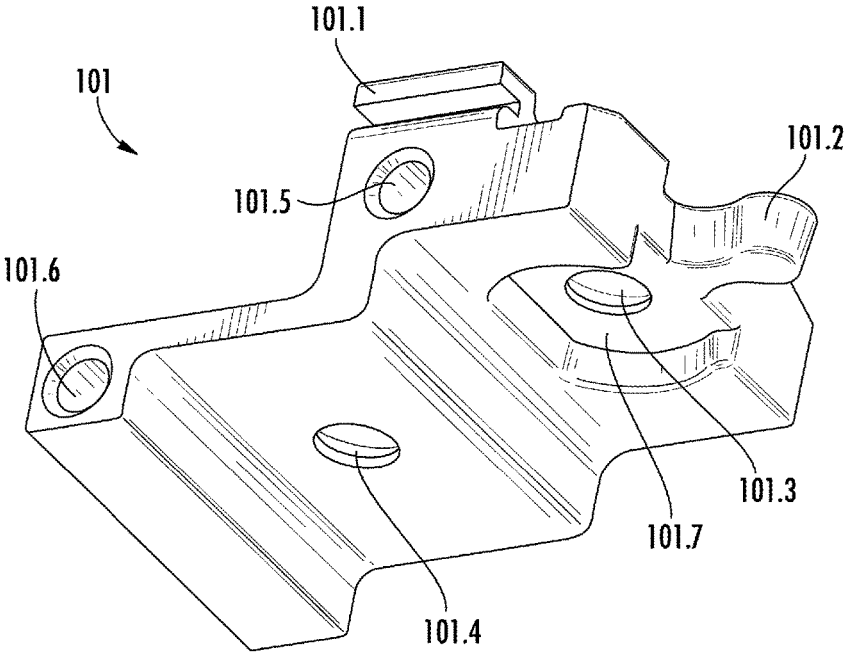

The modular rear trunnion fitting 101, which is shown in isolation in FIGS. 4A and 4B, includes an upper portion 101*a* and a lower portion 101*b* and is configured to attach to an upper rear portion of the receiver 10 and to interface with various configurations. In particular, the modular rear trunnion fitting 101 may include one or more upper slotted portions 101.1 configured to interface with the upper protrusions 10.1 of the receiver 10. The modular rear trunnion fitting 101 may also include an upper rear lateral hole 101.5 and a lower front lateral hole 101.6 configured to align with the holes 10.2 and 10.3, respectively, of the receiver 10. The interface between the holes of the modular rear trunnion fitting 101 (holes 101.5 and 101.6) and the holes of the receiver 10 (holes 10.2 and 10.3) may be secured using mechanical fasteners such as rivets, screws, bolts, etc. The attachment of the modular rear trunnion fitting 101 and the receiver 10 is shown in FIGS. 2A, 2B, 8A, and 8B (the receiver 10 is shown transparent in these images).

FIGS. 4A and 4B also show that the modular rear trunnion fitting 101 may include an upper mounting hole 101.3, a lower mounting hole 101.4, and a rear connection feature 101.2. As shown in FIG. 4B, in some embodiments, the upper mounting hole 101.3 may extend into a recessed area 101.7 on the underside of the modular rear trunnion fitting 101.

Figure 2A:
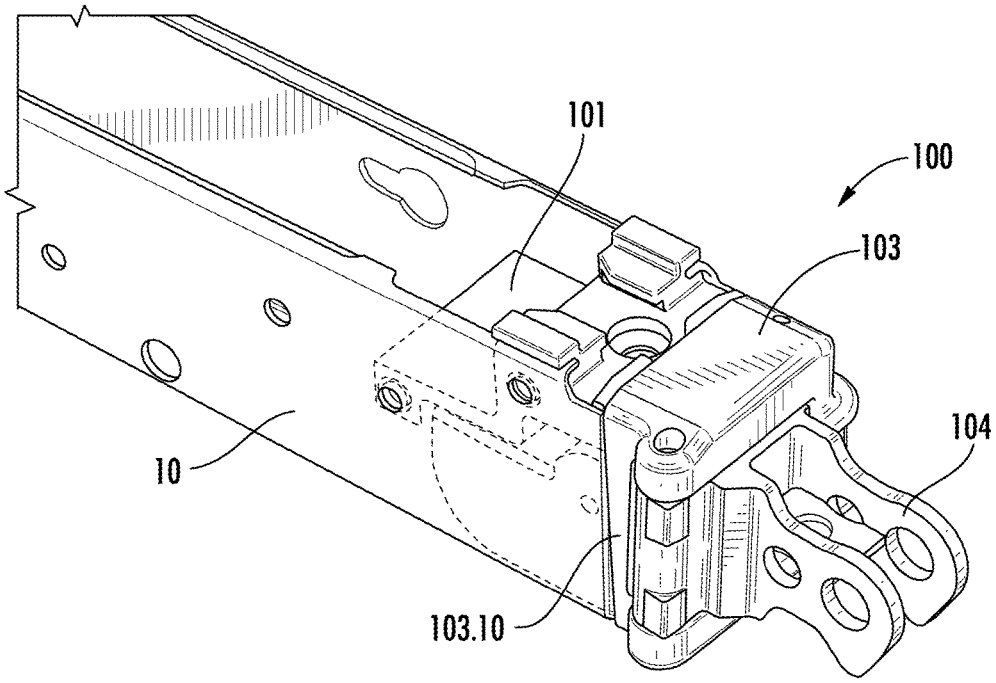
FIGS. 2A and 2B are perspective views of the rear trunnion assembly of FIG. 1.
Figure 2B:
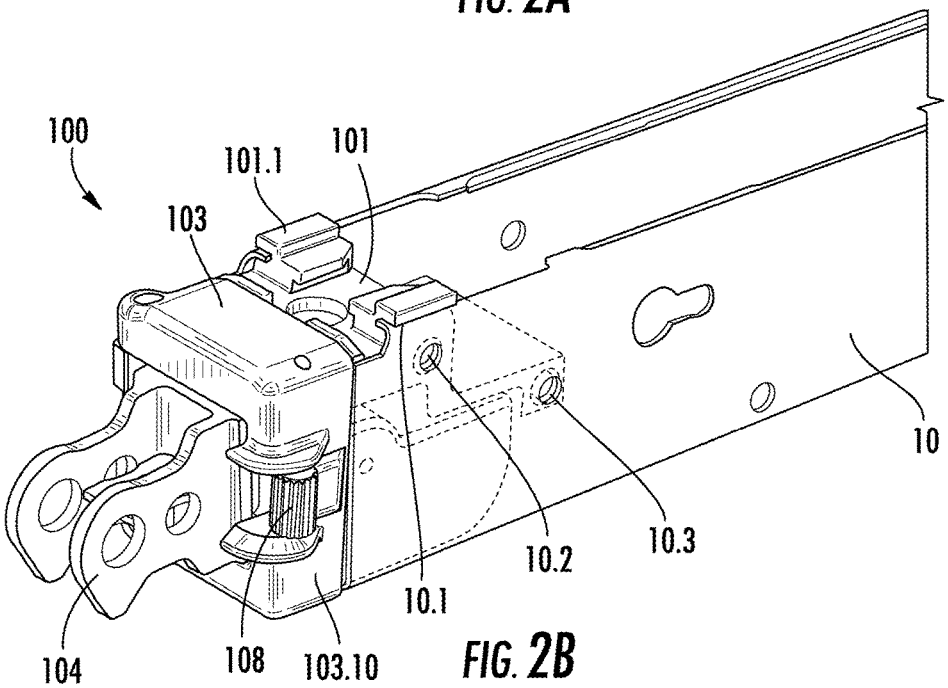
Figure 8A:
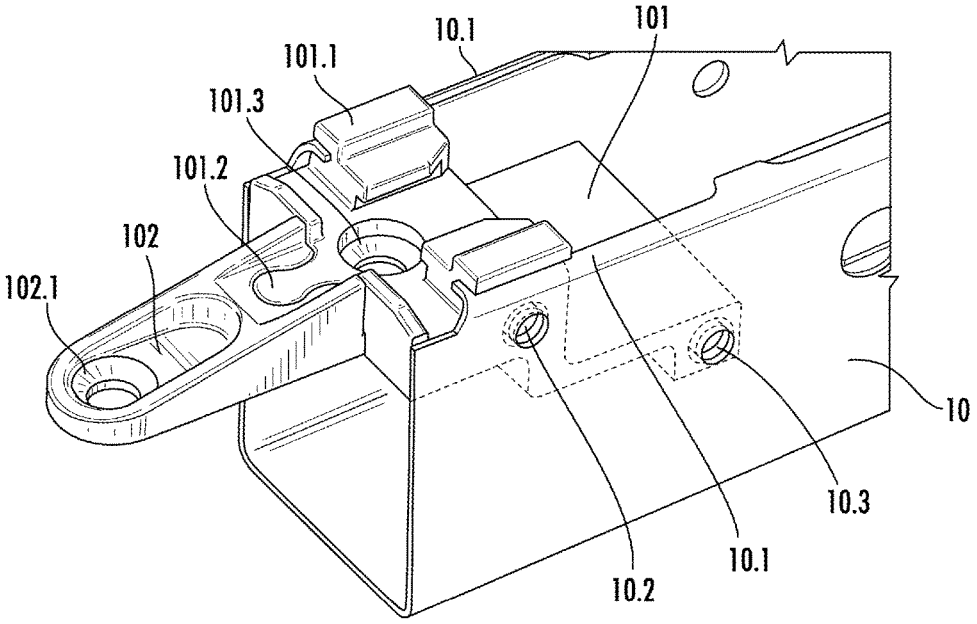
FIGS. 8A and 8B are perspective views of the rear trunnion assembly of FIG. 1.
Figure 8B:
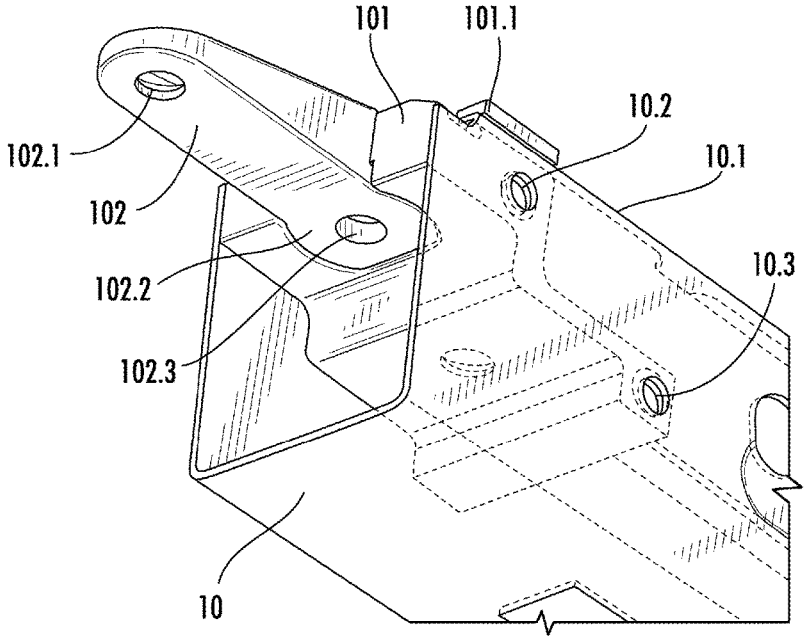

The modular rear trunnion fitting 101 can interface with a folding hinge fitting 103 as shown in FIGS. 2A and 2B for a folding configuration. In addition, the modular rear trunnion fitting 101 can interface with a removable tang 102 as shown in FIGS. 8A and 8B for a fixed stock configuration.

Folding Configuration

Figure 3A:
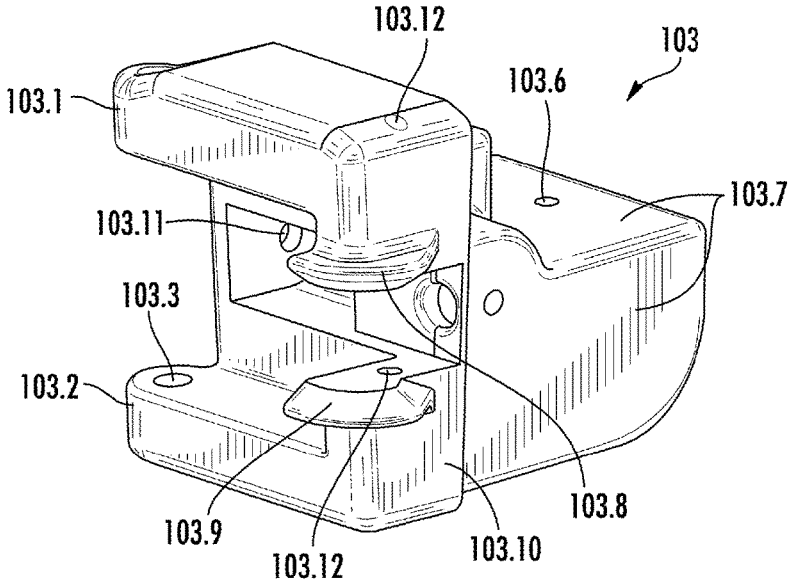
FIGS. 3A and 3B are perspective views of a folding hinge fitting of the rear trunnion assembly of FIG. 1.
Figure 3B:
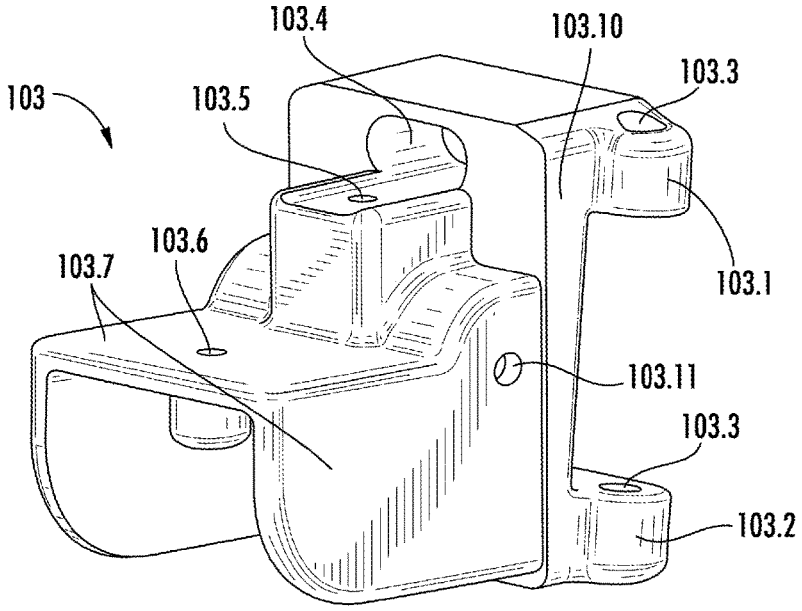

In some embodiments, the folding hinge fitting 103 includes a portion that is disposed under the modular rear trunnion fitting 101 and may be attached on a rear side of the modular rear trunnion fitting 101, see FIGS. 2A and 2B (or modular rear trunnion fitting 1001, described below). As shown in FIGS. 3A and 3B, the folding hinge fitting 103 may include a mounting hole 103.5 configured to align with upper mounting hole 101.3 of the modular rear trunnion fitting 101. Similarly, the folding hinge fitting 103 may include a mounting hole 103.6 configured to align with lower mounting hole 101.4 of the modular rear trunnion fitting 101. For the folding configuration, the rear connection feature 101.2 of the modular rear trunnion fitting 101 is disposed within cavity 103.4 (see FIG. 3B). The surfaces 103.7 of the folding hinge fitting 103 are inserted into the receiver 10 under the modular rear trunnion fitting 101 (see FIGS. 2A and 2B). The exterior surface 103.10 of the folding hinge fitting 103 is configured to be approximately continuous and/or co-planar with the external surface of the receiver 10 (see FIGS. 2A-3B). The cavity 103.11 defines a location for the retainer pin 109 and the push button arm 105 thus fixing the movement of the push button engagement/disengagement device.

As shown in FIGS. 2A-3B and 5A-5C, the folding hinge fitting 103 is configured to interface with a pivoting latch fitting 104. The pivoting latch fitting 104 (and the stock 20) fold about an axis defined by a pin (inserted through hole 104.1) configured to pass through hinge hole 103.3 such that the stock assembly will be supported by the upper lug 103.1 and lower lug 103.2. The folding hinge fitting 103 also includes an upper push button boss 103.8 and a lower push button boss 103.9 configured to interface with button 108. The upper push button boss 103.8 and the lower push button boss 103.9 prevent unintentional engagement of the button 108. In addition, the button 108 is configured to rotate (via slotted hole 108.2) about a pin inserted into button pivot hole 103.12.

Folding Mechanism

Figure 5A:
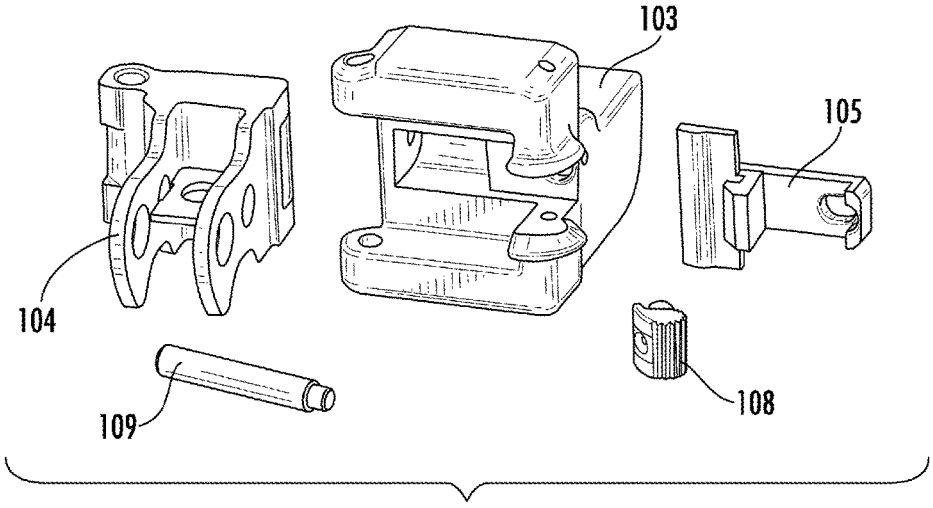
FIG. 5A is a partial exploded perspective view of the rear trunnion assembly of FIG. 1.
Figure 5B:
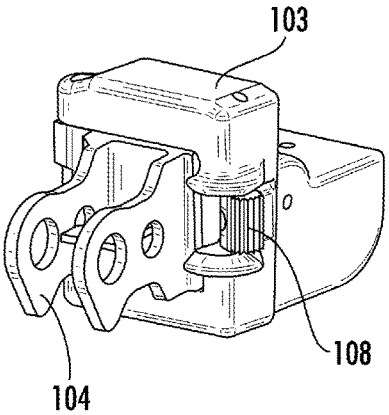
FIG. 5B is a partial perspective view in a deployed position of the rear trunnion assembly of FIG. 1.
Figure 5C:
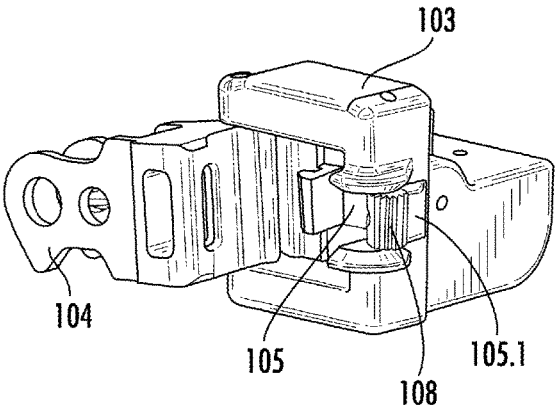
FIG. 5C is a partial perspective view in a partially folded position of the rear trunnion assembly of FIG. 1.

In some embodiments, the folding mechanism is configured to lock in at one or more positions (such as deployed and folded positions) where the locking conditions are controlled using the push button engagement/disengagement device. FIG. 5A shows an exploded view of the primary components of the engagement/disengagement device. FIGS. 5B and 5C show the deployed (stock extending rearward) and folded (or partially folded) positions, respectively. When the mechanism is in the deployed position, the engaging arm 105.3 of the push button arm 105 (see FIGS. 7A and 7B) engages the engagement slot 104.2 of the pivoting latch fitting 104 (see FIGS. 6A and 6B).

Figure 10:
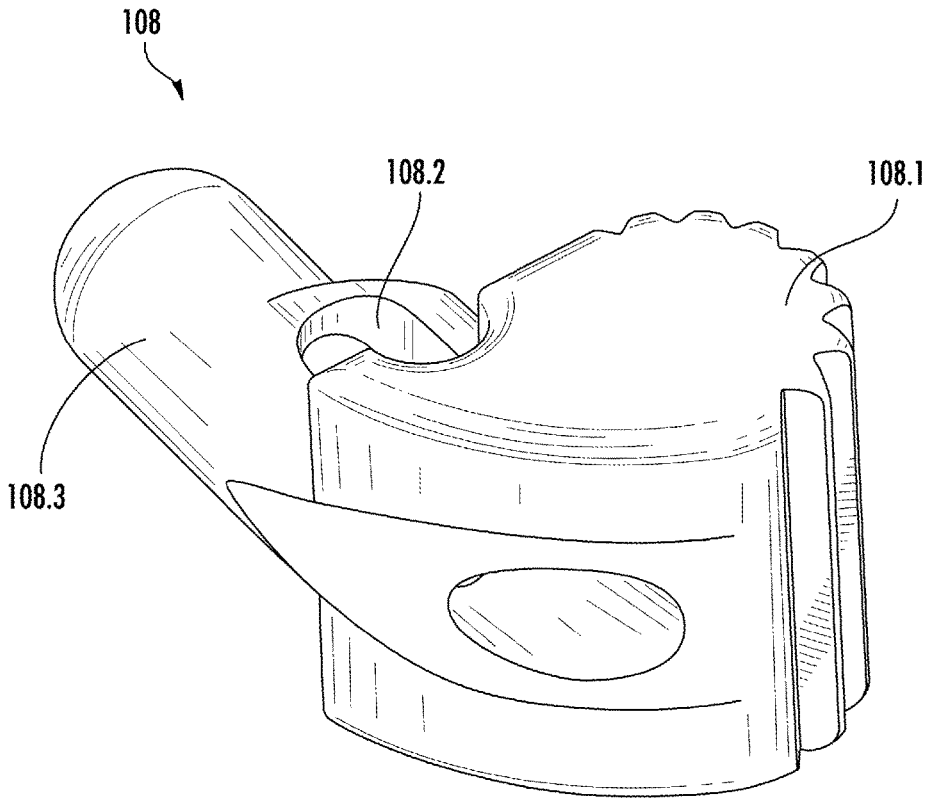
FIG. 10 is a perspective view of a button of the rear trunnion assembly of FIG. 1.

To disengage from the deployed position, the operator pushes interface portion 108.1 of the button 108 (toward the longitudinal centerline of the receiver 10) such that the button pivots about a pin extending through slotted hole 108.2 (see FIG. 10) where the pin also extends through button pivot hole 103.12 of the folding hinge fitting 103. The rotation of the button 108 causes the protrusion 108.3 to engage the platform 105.1 of the push button arm 105 such that the push button arm 105 moves in a lateral direction toward the right side of the receiver (away from the hinge hole 103.3). The push button arm 105 is guided by sleeve 105.4 sliding along retainer pin 109 (and against the spring pressure provided by the retainer pin 109). The retainer pin 109 is disposed within cavity 103.11. This movement of the push button arm 105 disengages the engaging arm 105.3 of the push button arm 105 from the engagement slot 104.2 of the pivoting latch fitting 104. In addition to disengaging the engaging arm 105.3 from the engagement slot 104.2, the movement of the push button arm 105 causes the protrusion 105.5 on the surface of the plate 105.2 (see FIG. 7A) to bear against the protrusion 104.5 on the surface of the pivoting latch fitting 104 (see FIG. 6B). The force applied between these two protrusions 105.5, 104.5 (which occurs approximately simultaneously as the disengagement of the engaging arm 105.3 from the engagement slot 104.2) pushes and causes the pivoting latch fitting 104 to rotate about the pivot hole 104.1. The small rotation of the pivoting latch fitting 104 caused by the force applied between the two protrusions 105.5, 104.5 prevents reengagement between the engaging arm 105.3 from the engagement slot 104.2 when the button 108 is released (such that the push button arm 105 returns to the original or default position). The pivoting latch fitting 104 is free to rotate to a position such as that shown in FIG. 5C.

Figure 6A:
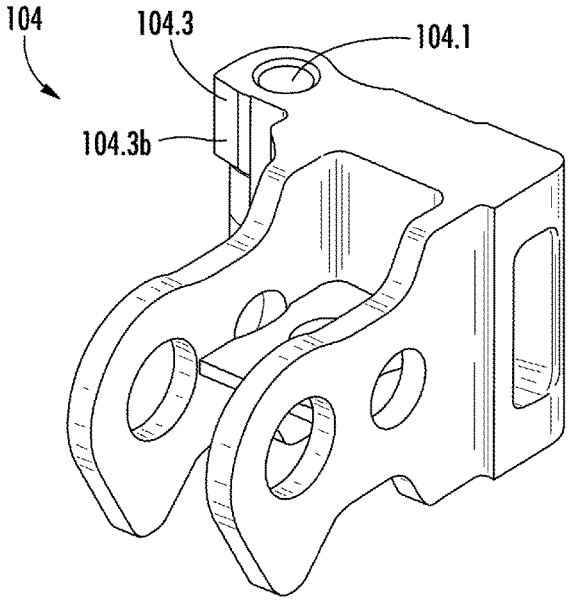
FIGS. 6A and 6B are perspective views of a pivoting latch fitting of the rear trunnion assembly of FIG. 1.
Figure 6B:
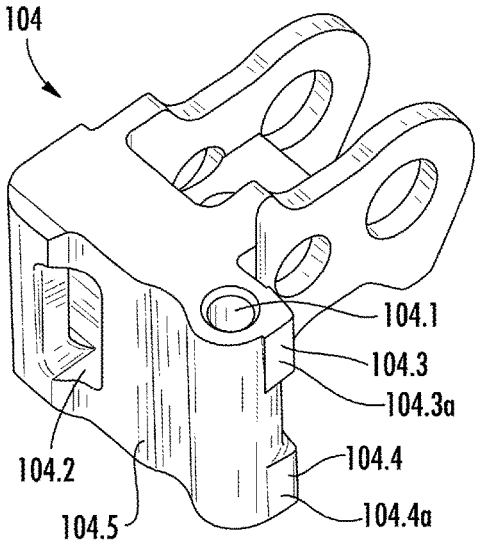
Figure 6C:
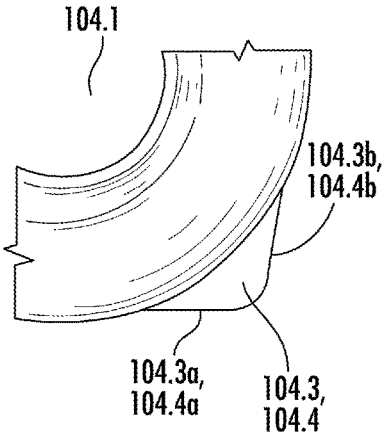
FIG. 6C is a partial top view of a pivoting latch fitting of the rear trunnion assembly of FIG. 1.
Figure 7A:
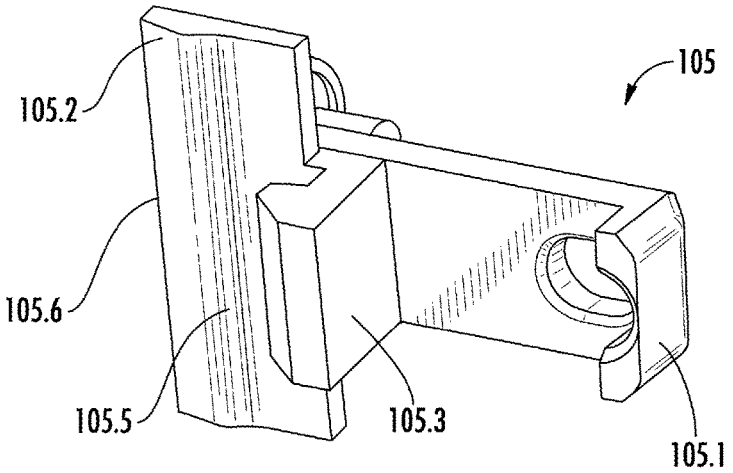
FIGS. 7A, 7B, and 7C are perspective views of a push button arm of the rear trunnion assembly of FIG. 1.
Figure 7B:
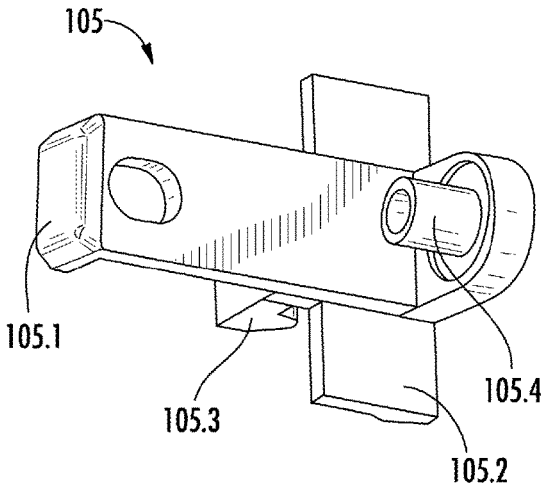
Figure 7C:
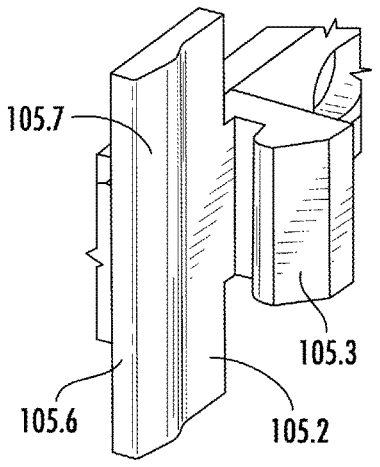

In some embodiments, the engagement/disengagement device also includes provisions for securing the pivoting latch fitting 104 in the fully folded position (i.e., folded around the pivot hole 104.1 such that the stock 20 is approximately adjacent to the receiver 10). As shown in FIGS. 6A and 6B, the pivoting latch fitting 104 includes an upper protrusion 104.3 and a lower protrusion 104.4 disposed adjacent to the pivot hole 104.1. As the pivoting latch fitting 104 rotates toward the fully folded position, the leading faces 104.3*a*, 104.4*a* of the upper and lower protrusions 104.3, 104.4 (respectively) press against the end surface 105.6 of the plate 105.2. Upon sufficient force to overcome the spring pressure associated with the push button arm 105, the push button arm 105 moves toward the right side of the receiver (away from the hinge hole 103.3) enough for the outer edges of the upper and lower protrusions 104.3, 104.4 to rotate beyond the plate 105.2. After the outer edges have cleared the end surface 105.6 of the plate 105.2, based on spring pressure, the plate 105.2 will immediately return to the default position. In some embodiments, the movement of the plate 105.2 returning to the default position create a detectable "click" (audible and/or tactile) to alert the operator that the stock is engaged in the fully folded position. Any attempt to rotate the pivoting latch fitting 104 back toward the deployed position causes the trailing faces 104.3*b*, 104.4*b* of the upper and lower protrusions 104.3, 104.4 (respectively) to press against the surface 105.7 of the push button arm 105. To disengage the pivoting latch fitting 104 from the fully folded position, the push button arm 105 must move toward the right side of the receiver (away from the hinge hole 103.3). This movement occurs based on the pivoting movement of the button 108 (as described above). In other words, in some embodiments, the button 108 may also be used to disengage the stock from the fully folded position.

Fixed Configuration

Figure 9:
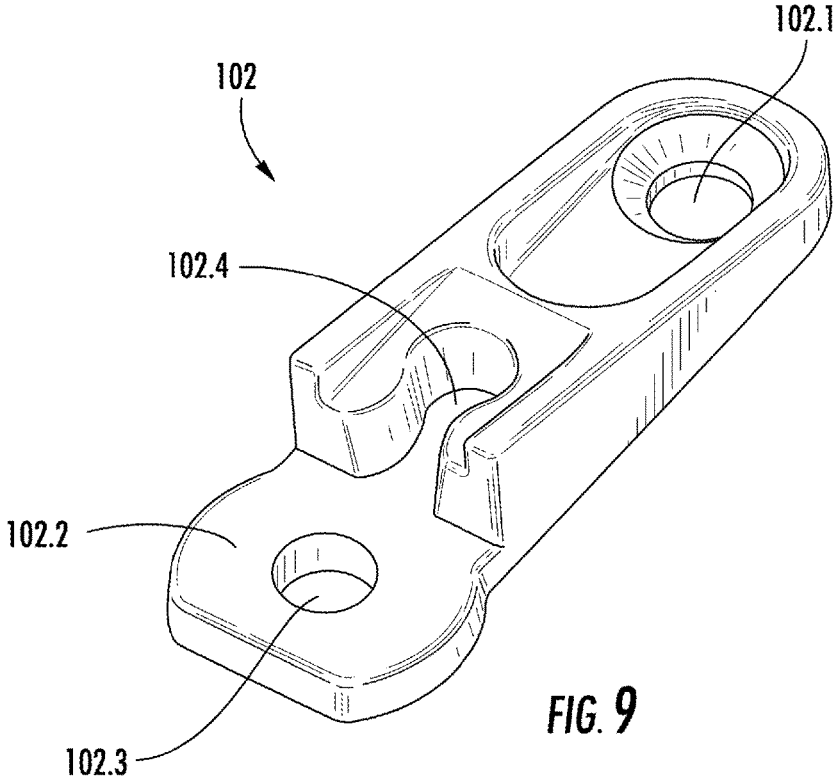
FIG. 9 is a perspective view of a removable tang of the rear trunnion assembly of FIG. 1.
Figure 12:
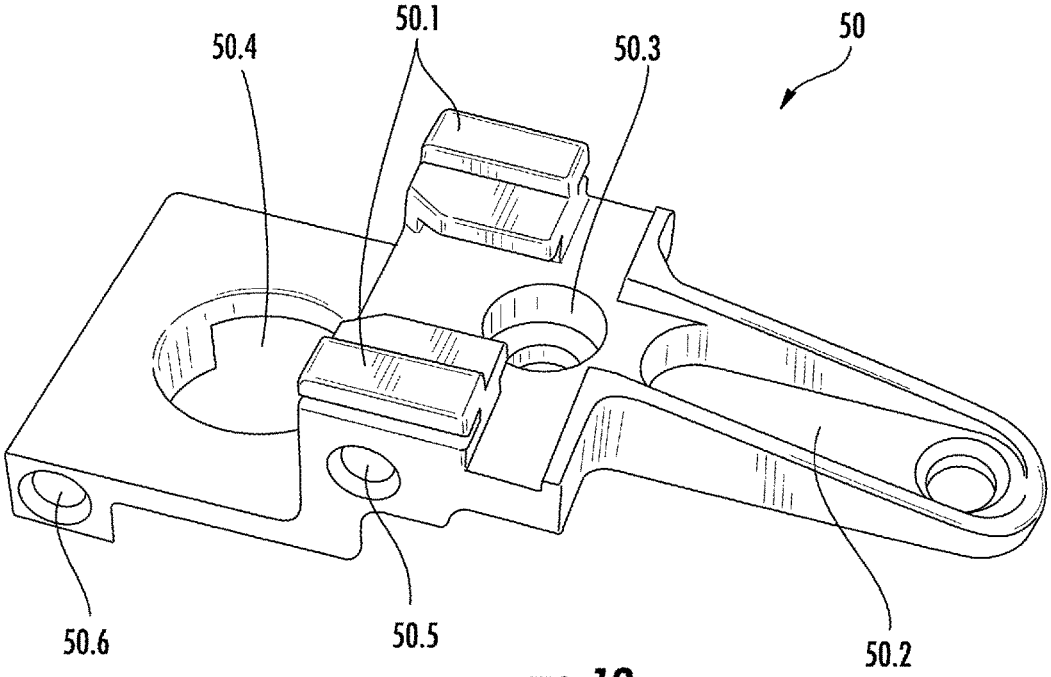
FIG. 12 (PRIOR ART)
FIG. 12 is a perspective view of a related art rear trunnion fitting.

In some embodiments, the removable tang 102 may be attached to the rear connection feature 101.2 of the modular rear trunnion fitting 101 as shown in FIGS. 8A and 8B (or the rear connection feature 1001.2 of the modular rear trunnion fitting 1001, described below). As shown in FIG. 9, the removable tang 102 includes a recess 102.4 that is complementary to the rear connection feature 101.2 of the modular rear trunnion fitting 101. Although the drawings illustrate these features as a rounded keyhole shape, these features may have any appropriate shape to ensure sufficient engagement with one another. In addition to the recess 102.4 and rear connection feature 101.2 interface, the removable tang 102 may include a hole 102.3 that is aligned with the upper mounting hole 101.3 of the modular rear trunnion fitting 101 (when the removable tang 102 is in the installed position). As shown in FIG. 12, some rear trunnion fittings 50 include an integral tang 50.2 that may have to be cut off to attach a folding stock, which is a permanent change that eliminates the ability to switch back to a fixed stock. The modular rear trunnion fitting 101 allows quick changes between a folding configuration and a fixed configuration using hand tools without permanent changes to the components.

Split Rear Trunnion Fitting

Figure 11A:
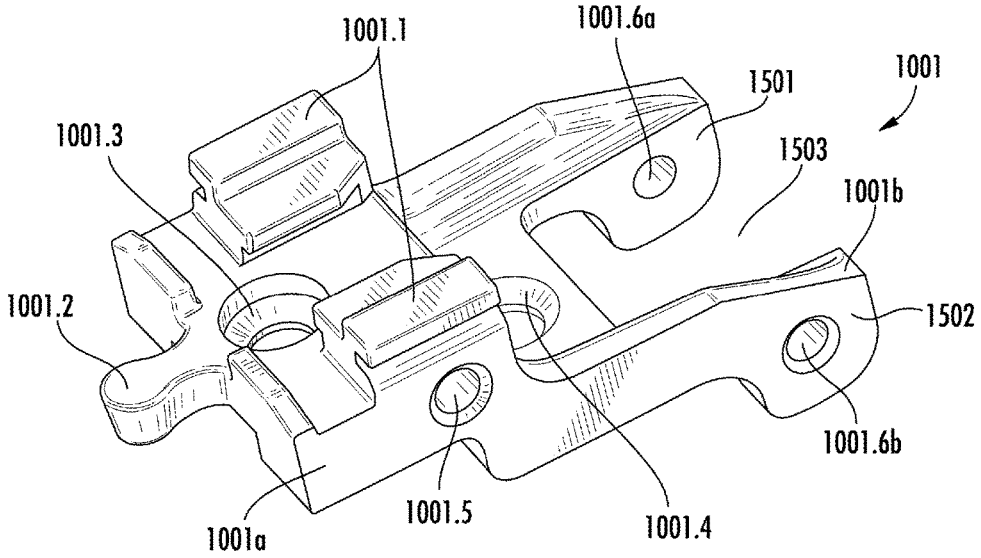
FIGS. 11A and 11B are perspective views of a modular rear trunnion fitting of the rear trunnion assembly of FIG. 1.
Figure 11B:
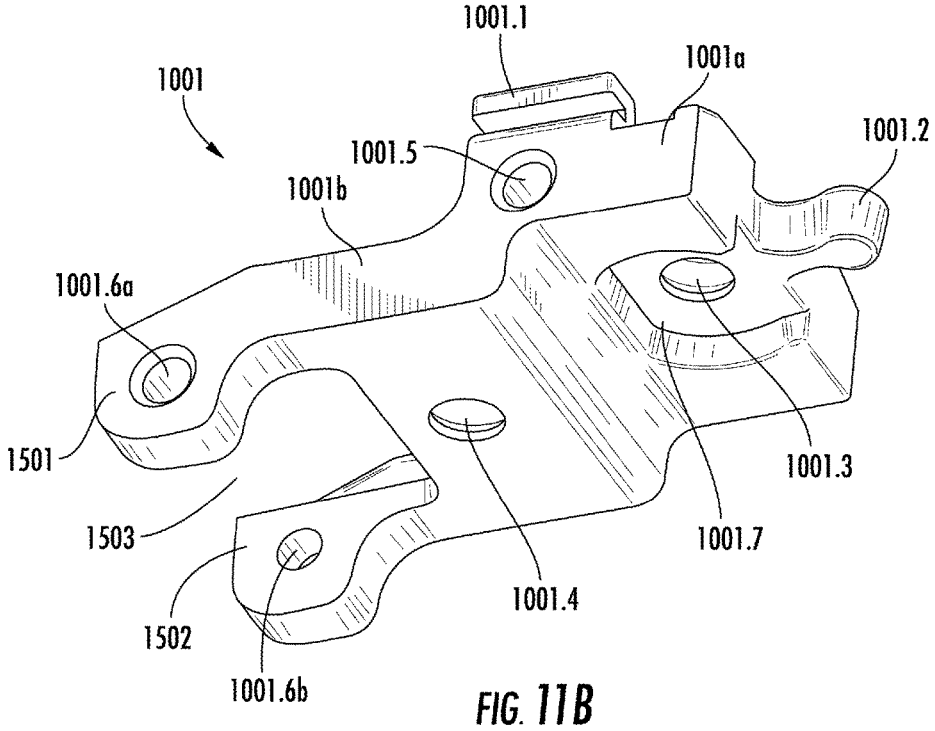

As shown in FIGS. 11A and 11B, in some embodiments, the rear trunnion assembly 100 may include a modular split rear trunnion fitting 1001. The modular split rear trunnion fitting 1001 includes an upper portion 1001*a* and a lower portion 1001*b* and is configured to attach to an upper rear portion of the receiver 10 and to interface with various configurations. In particular, the modular split rear trunnion fitting 1001 may include one or more upper slotted portions 1001.1 configured to interface with the upper protrusions 10.1 of the receiver 10. In some embodiments, lower portion 1001*b* includes a first arm 1501 and a second arm 1502, which are separated by an open space 1503. The two arms 1501, 1502 include lower front lateral holes 1001.6*a* and 1001.6*b*, respectively, which are configured to align with the hole 10.3 of the receiver 10. The upper portion 1001*a* of the modular split rear trunnion fitting 1001 may include an upper rear lateral hole 1001.5 configured to align with the hole 10.2 of the receiver 10. The interface between the holes of the modular split rear trunnion fitting 1001 (holes 1001.5, 1001.6*a*, and 1001.6*b*) and the holes of the receiver 10 (holes 10.2 and 10.3) may be secured using mechanical fasteners such as rivets, screws, bolts, etc. The open space 1503 provides more room for other components within the receiver 10. In addition, separating the two arms 1501, 1502 from one another simplifies manufacturing and assembly of the components. For example, the two arms 1501, 1502 allow separate fasteners for each of the holes 1001.6*a* and 1001.6*b* (i.e., for attachment to receiver 10).

FIGS. 11A and 11B also show that the modular split rear trunnion fitting 1001 may include an upper mounting hole 1001.3, a lower mounting hole 1001.4, and a rear connection feature 1001.2. As shown in FIG. 11B, in some embodiments, the upper mounting hole 1001.3 may extend into a recessed area 1001.7 on the underside of the modular split rear trunnion fitting 1001.

The modular split rear trunnion fitting 1001 can interface with a folding hinge fitting 103 (similar to FIGS. 2A and 2B) for a folding configuration. In addition, the modular split rear trunnion fitting 1001 can interface with a removable tang 102 (similar to FIGS. 8A and 8B) for a fixed stock configuration.

The interface between the modular split rear trunnion fitting 1001 and the folding hinge fitting 103 is similar to the interface between the modular split rear trunnion fitting 101 and the folding hinge fitting 103 and thus is not described in detail. The interface between the modular split rear trunnion fitting 1001 and the removable tang 102 is similar to the interface between the modular split rear trunnion fitting 101 and the removable tang 102 and thus is not described in detail.

The components of the rear trunnion assembly 100 may be formed of materials including, but not limited to, steel, aluminum, stainless steel, high strength aluminum alloy, carbon composite, plastic, thermoplastic, nylon, other plastic or polymer materials, other metallic materials, other composite materials, or other similar materials. Moreover, the components of the rear trunnion assembly 100 may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A rear trunnion assembly for a firearm, the rear trunnion assembly comprising:

a modular rear trunnion fitting attached to a rear portion of a receiver of the firearm, the modular rear trunnion fitting comprising an upper portion and a lower portion; and a removable tang removably installed to a rear side of the modular rear trunnion fitting, wherein:

the upper portion of the modular rear trunnion fitting comprises a rear connection feature extending rearward from the upper portion;

the rear connection feature is the only part of the modular rear trunnion fitting that extends beyond a rear end of the receiver; and the removable tang is configured to engage a fixed stock.

2. The rear trunnion assembly of claim 1, wherein the modular rear trunnion fitting is a modular split rear trunnion fitting that comprises a first arm and a second arm, which are separated by an open space, wherein the first and second arms each extend toward a front of the receiver.

3. The rear trunnion assembly of claim 1, wherein the removable tang comprises a recess that engages the rear connection feature of the modular rear trunnion fitting.

4. The rear trunnion assembly of claim 3, wherein the recess of the removable tang comprises a rounded keyhole shape that is complementary to a shape of the rear connection feature of the modular rear trunnion fitting.

5. The rear trunnion assembly of claim 3, wherein the recess comprises an opening on an upper side of the removable tang such that the removable tang interfaces with an underside of the rear connection feature of the modular rear trunnion fitting.

6. The rear trunnion assembly of claim 1, wherein the removable tang comprises a forward portion that interfaces with an underside surface of the upper portion of the modular rear trunnion fitting.

7. The rear trunnion assembly of claim 6, wherein the forward portion of the removable tang comprises a mounting hole that is aligned with an upper mounting hole of the upper portion of the modular rear trunnion fitting.

8. The rear trunnion assembly of claim 6, wherein the underside surface of the upper portion of the modular rear trunnion fitting comprises a recessed area that has a complementary shape to a shape of the forward portion of the removable tang.

9. The rear trunnion assembly of claim 1, wherein an underside surface of the removable tang is approximately coplanar with an underside surface of the upper portion of the modular rear trunnion fitting when the removable tang is installed.

10. The rear trunnion assembly of claim 1, wherein, when the removable tang is uninstalled, the rear connection feature is configured to engage a folding hinge fitting.

* * * * *